US006644942B2

(12) United States Patent
Rival et al.

(10) Patent No.: US 6,644,942 B2
(45) Date of Patent: Nov. 11, 2003

(54) MONOBLOC HOUSING FOR VACUUM PUMP

(75) Inventors: Jean-Luc Rival, Gruffy (FR); Albert Cacard, Groisy (FR); François Houze, Cuvat (FR)

(73) Assignee: Alcatel, Paris (FR)

( * ) Notice: Subject to any disclaimer, the term of this patent is extended or adjusted under 35 U.S.C. 154(b) by 19 days.

(21) Appl. No.: 10/088,168

(22) PCT Filed: Jul. 17, 2001

(86) PCT No.: PCT/FR01/02314

§ 371 (c)(1),
(2), (4) Date: Mar. 15, 2002

(87) PCT Pub. No.: WO02/06675

PCT Pub. Date: Jan. 24, 2002

(65) Prior Publication Data

US 2002/0150484 A1 Oct. 17, 2002

(30) Foreign Application Priority Data

Jul. 18, 2000 (FR) ..... 00 09401

(51) Int. Cl.[7] ..... F04B 17/00; F04B 35/04

(52) U.S. Cl. ..... 417/410.4; 417/373; 417/410.1; 417/410.3

(58) Field of Search ..... 417/410.4, 423.14, 417/410.1, 410.3, 423.1, 423.7, 373

(56) References Cited

U.S. PATENT DOCUMENTS 2,940,661 A 4/1960 Lorenz
4,384,226 A 5/1983 Sato et al.
4,983,106 A * 1/1991 Wright et al. ..... 418/2
5,767,606 A * 6/1998 Bresolin ..... 310/254
5,779,453 A * 7/1998 Nagayama et al. ..... 417/410.4
5,836,746 A * 11/1998 Maruyama et al. ..... 417/44.1
5,904,473 A 5/1999 Dahmlos et al.
6,002,185 A 12/1999 Nakao et al.
6,069,421 A * 5/2000 Smith et al. ..... 310/43
6,457,950 B1 * 10/2002 Cooper et al. ..... 417/366
6,471,494 B1 * 10/2002 Miura et al. ..... 417/410.4
6,554,584 B2 * 4/2003 Takura et al. ..... 417/355

FOREIGN PATENT DOCUMENTS

EP 0 733 804 A2 9/1996

OTHER PUBLICATIONS

Patent Abstracts of Japan, vol. 1996, No. 04, Apr. 30, 1996 and JP 07 317673 A (Ebara Corp.) Dec. 5, 1995.
Patent Abstracts of Japan, vol. 010, No. 134 (M–479), May 17, 1986 & JP 60 259791 A, (Hitachi Seisakusho KK), Dec. 21, 1985.

* cited by examiner

*Primary Examiner*—Charles G. Freay
*Assistant Examiner*—Michael K. Gray
(74) *Attorney, Agent, or Firm*—Sughrue Mion, PLLC

(57) ABSTRACT

The invention concerns a pumping unit wherein the vacuum pump (100) is driven by a motor (3, 4) comprised in a common monobloc housing forming motor housing (5) and oil pan (18) containing a gear assembly (17) for coupling two parallel pump rotors (14). To complement the sealing conditions provided by a dynamic seal (6), the motor stator (4) consists of an electric coil embedded in an oil-tight and gas-tight resin, thereby not requiring other more expensive and bulky sealing means, reducing production cost and enhancing the pumping unit dependability.

6 Claims, 2 Drawing Sheets

MONOBLOC HOUSING FOR VACUUM PUMP

TECHNICAL FIELD OF THE INVENTION

The present invention relates to dry vacuum pump units for establishing a fine vacuum, for use in particular in the semiconductor industry to lower the pressure in process chambers, down from atmospheric pressure.

The present invention relates more particularly to dual-rotor vacuum pump units comprising a pump stator with at least one axial internal cavity receiving two parallel pump rotors mounted to rotate on corresponding bearings and coupled at a first end via gears enclosed in a casing containing oil. The first end of one of the rotors is extended by a coaxial drive shaft which is engaged in the rotor of a motor for driving the vacuum pump. The motor has a stator with a stator coil and is enclosed in a motor casing running on from the casing containing the gears and oil. Known structures for vacuum pump units are described in EP 0 733 804, U.S. Pat. Nos. 5,904,473, 2,940,661, and JP 60 259791.

In vacuum pump units, one of the difficulties is to provide satisfactory sealing in the motor for driving the vacuum pump so as to prevent any oil and gas escaping to the outside through the motor, in particular along the conductors feeding the motor stator coil. Because of the very high speed of rotation of the vacuum pump, e.g. about 6000 revolutions per minute (rpm), it is difficult to provide satisfactory sealing via the dynamic seals provided around the motor shaft between the motor and the gears. This results in a tendency for oil to escape outwards through the motor. In addition, the vacuum pumps used in industrial processes contain toxic and polluting gases which it is essential to prevent from escaping into the surrounding atmosphere.

In a known vacuum pump, as shown in FIG. 1, sealing is provided by a leakproof intermediate jacket between the rotor and the stator of the motor. FIG. 1 is a longitudinal section view showing the first end of the stator 1 of a vacuum pump 100 having a drive shaft 2 extending the pump rotor (not shown). The drive shaft 2 is engaged in a motor unit 200, where it is secured to the rotor 3 of the motor. The rotor 3 of the motor is mounted to rotate on bearings inside the stator 4 of the motor which includes a stator coil 11 fed by electrical conductors (not shown). The assembly comprising the stator 4 and the rotor 3 of the motor is inserted in a motor casing 5. Seals can provide sealing around the drive shaft 2 where it enters the motor casing 5 to isolate the atmosphere inside the motor casing 5 as much as possible from the upstream compartment 7 containing a set of gears 8 for coupling together the two parallel rotors of the vacuum pump 100. The gears 8 distribute rotary motion between the two rotors, with only one of the rotors being coupled in line with the drive shaft 2. The upstream compartment 7 containing the gears 8 also contains oil for lubricating the gears. In order to guide the rotor 3 of the motor radially, so as to reduce vibration, an additional bearing 15*a* is placed between the gears 8 and the rotor 3 of the motor.

The seals are not sufficiently effective to prevent lubricating oil for the gears 8 and toxic gases coming from the vacuum pump 100 passing into the outside atmosphere through the motor casing 200, and in particular along the conductors feeding the stator coil 11 of the motor. To prevent oil and gases migrating to the outside atmosphere through the motor unit 200, the known structure shown in FIG. 1 has a leakproof jacket 9, in the form of a coaxial bell, whose mouth 10 is received in leaktight manner around its entire periphery between two portions of the motor casing 5, i.e. a main portion 51 and a fixing base 52. The leakproof jacket 9 has a cylindrical intermediate portion 90 which is engaged in the airgap between the stator 4 of the motor and the rotor 3 of the motor, and which is connected both to the bell mouth 10 of the jacket and to an end wall 91 thereof.

A first drawback of such a known structure is its complexity due to the fact that it is necessary to provide and to assemble together a plurality of parts, comprising the leakproof jacket 9, and the two-part motor casing 51 and 52. That increases the cost of making the vacuum pump.

A second drawback is that the presence of the cylindrical intermediate portion 90 of the leakproof jacket 9 engaged in the airgap between the stator 4 and the rotor 3 of the motor means that it is necessary to have an airgap of relatively large width, thereby increasing the amount of electricity that needs to be consumed in order to drive the vacuum pump 100.

Another drawback is that the presence of the leakproof jacket 9 increases the length of the motor, moving the stator 4 and the rotor 3 thereof away from the vacuum pump 100, and increasing the cantilevered-out length of the drive shaft; that increases motor vibration, and also the noise generated by the assembly comprising the vacuum pump 100 and the motor unit 200, and it also requires the presence of the additional bearing 15*a* between the gears 8 and the rotor 3 of the motor.

Another drawback lies in the leakproof jacket, which is made of metal, being subjected to an alternating magnetic field in the airgap of the motor. This results in current being induced in the material constituting the leakproof jacket, in energy losses, and in additional heating of the motor. These losses increase with the frequency of the magnetic field and they become prohibitive in a four-pole motor powered at double frequency.

JP 07 317673 discloses a screw pump for various fluids. The drive motor is disposed in an intermediate zone of one of the rotor shafts, between the pump rotors and the gears coupling the shafts together. The motor casing is distinct from the casing for the coupling gears. That structure is neither designed nor adapted to resolve the problems specific to sealing vacuum pumps.

U.S. Pat. No. 6,002,185 discloses a motor for coupling to a valve in order to open it. The motor coil is embedded in the mass constituting the motor casing so as to avoid any cracking that could lead to corrosive moisture forming on the stator of the motor.

SUMMARY OF THE INVENTION

A particular object of the present invention is to avoid the drawbacks of known vacuum pump structures by proposing a new structure for a dual-rotor vacuum pump unit associated with a motor which is sealed in a manner that is simultaneously simple, low cost, and more effective.

The invention seeks to eliminate the leakproof jacket 9, replacing it by other means for effectively ensuring sealing and opposing any oil and gas migrating through the motor to the atmosphere.

To achieve these objects and others, the invention provides a dual-rotor vacuum pump unit comprising a pump stator with at least one axial internal cavity receiving two parallel pump rotors mounted to rotate on corresponding bearings and coupled together at a first end by a set of gears enclosed in a gear casing containing oil, the first end of one of the pump rotors being extended axially by a drive shaft engaged in the rotor of a motor unit for driving the vacuum pump, the motor unit having a stator coil and being enclosed in a motor casing extending the gear casing; according to the invention:

the motor casing and the gear casing form a common one-piece casing connected to the first end of the pump stator of the vacuum pump;

inside the common one-piece casing, the stator coil of the motor unit is embedded in a leakproof resin providing sealing that prevents oil and gas from escaping to the outside along the feeding conductors.

This avoids resorting to sealing means that are bulkier and more expensive and as a result production cost is reduced and reliability of the pump unit is improved.

This also avoids the losses that result from induction currents that are inevitably generated in the mass of material constituting a leakproof jacket engaged in the airgap between the rotor and the stator of the motor.

In an advantageous embodiment, the common one-piece casing includes an intermediate wall between a first compartment containing the motor and a second compartment containing the set of gears, and including a passage for the drive shaft with a dynamic seal to provide sealing around the drive shaft between the first compartment and the second compartment.

For convenience in assembly, the common one-piece casing may have an axial end opening closed in leakproof manner by a closure hatch.

Additional reduction in vibration is obtained by providing for the common one-piece casing to be connected to the first end of the pump stator via a bearing support having a first bearing for guiding the drive shaft located as close as possible to the motor. This reduces the cantilevered-out length of the drive shaft. Reduction in the total length and in the cantilevered-out length is further facilitated by the fact that impregnating the motor stator in the leakproof resin makes it possible to move it closer to its casing, since insulation distances can be reduced because of the dielectric quality of the leakproof resin.

BRIEF DESCRIPTION OF THE DRAWINGS

Other objects, characteristics, and advantages of the present invention appear from the following description of particular embodiments given with reference to the accompanying figures, in which.

DESCRIPTION OF PREFERRED EMBODIMENTS

Figure 2:
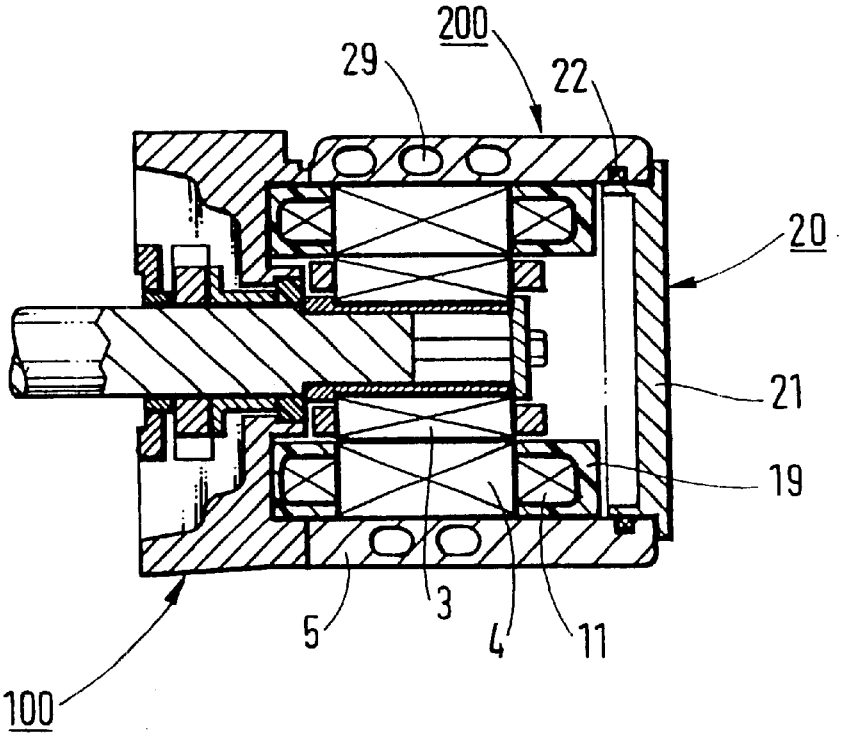
PRIOR ART FIG. 2
FIG. 2 is a longitudinal section view of a motor unit of a structure constituting an embodiment of the present invention.
Figure 3:
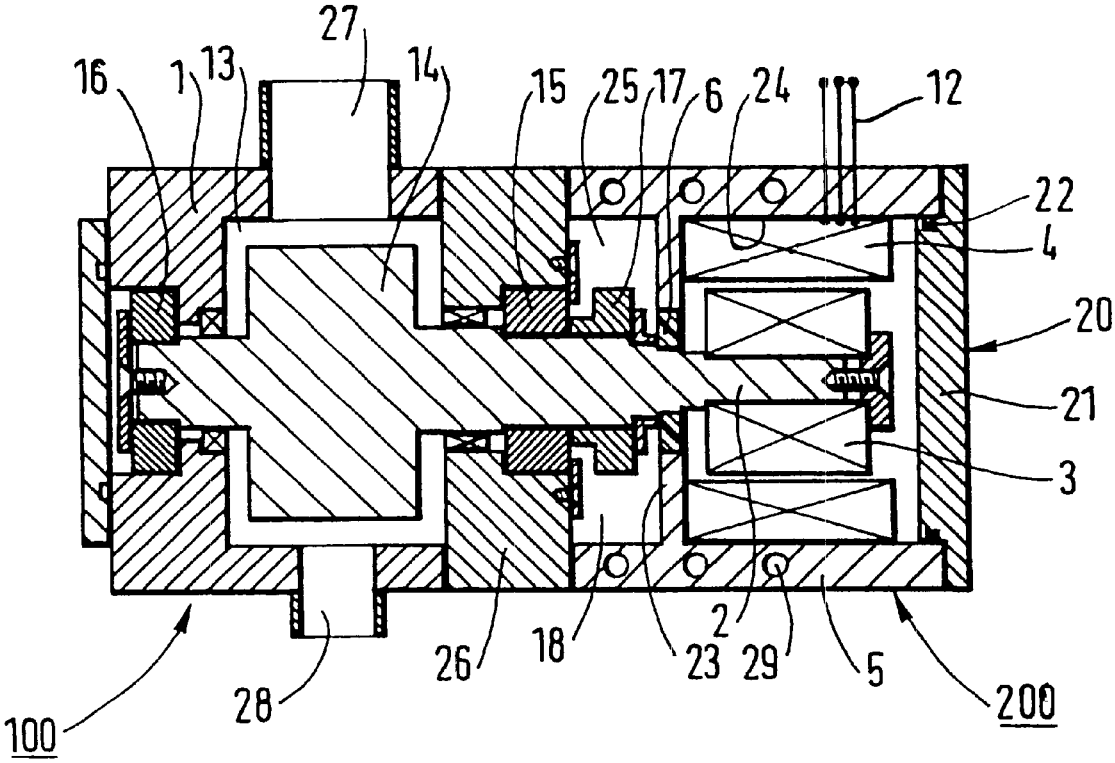
FIG. 3 is a diagrammatic longitudinal section view showing a vacuum pump unit constituting another embodiment of the present invention.
Figure 4:
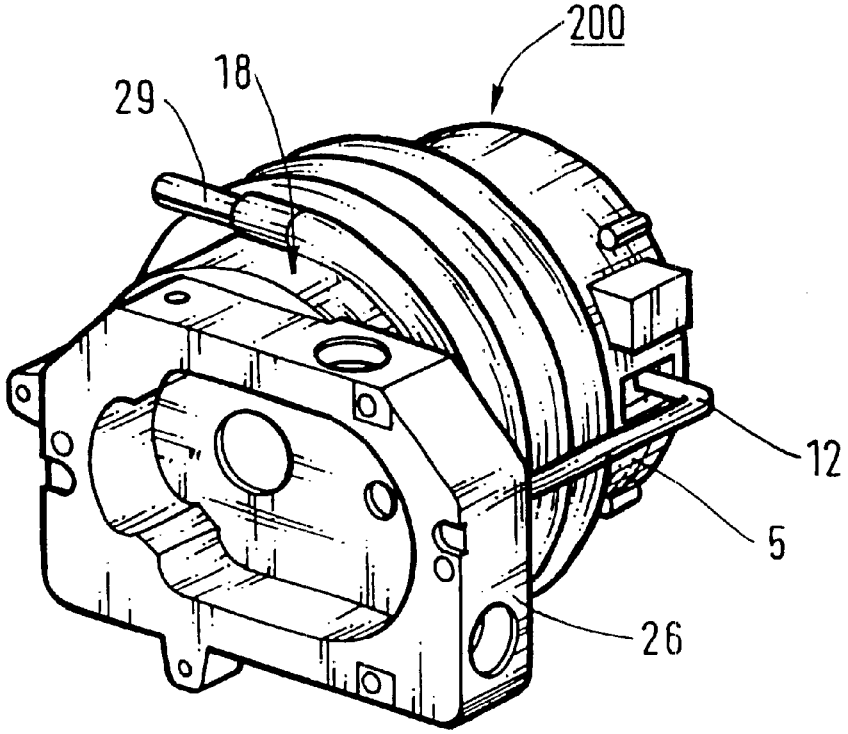
FIG. 4 is a perspective view of the motor casing and the gear casing constituting an embodiment of the present invention.

A vacuum pump unit of the invention as shown in FIGS. 2 to 4 comprises a dual-rotor vacuum pump 100 driven by a motor unit 200 powered electrically by a power feed line 12.

The vacuum pump 100 comprises a pump stator 1 having at least one axial internal cavity 13 receiving two parallel pump rotors mounted to rotate on corresponding bearings. The figures show only one of the pump rotors 14, having a first end held in the pump stator 1 by a first bearing 15 and a second end held by a second bearing 16.

The two pump rotors such as the pump rotor 14 are coupled together at their first ends by a set of gears 17 enclosed in a gear casing 18 containing oil.

The first end of the pump rotor 14 is extended axially by the drive shaft 2 penetrating into the motor casing 5. The drive shaft 2 is engaged in the rotor 3 of the motor, which is itself mounted to rotate in the stator 4 of the motor which is contained in the motor casing 5. The stator 4 of the motor comprises a stator coil 11 (FIG. 2).

In the invention, the motor casing 5 and the oil-containing gear casing 18 form a common one-piece casing, advantageously made of metal and secured to the first end of the pump stator 1. Inside the common one-piece casing, the stator coil 11 of the motor unit 200 is embedded in a leakproof resin 19 (FIG. 2) which provides sealing against both oil and gases, preventing oil and gas escaping to the outside along the conductors of the motor power supply line 12.

In the embodiment shown in FIGS. 2 and 3, the common one-piece casing 5, 18 has an axial end opening 20 which is closed in leakproof manner by a closure hatch 21 associated with an interposed sealing ring 22.

Between the motor casing portion 5 and the gear casing portion 18, the common one-piece casing has an intermediate wall 23, separating the first compartment 24 containing the motor 3, 4 from the second compartment 25 containing the set of gears 17, with an axial passage for the drive shaft 2 and with a dynamic seal 6 for providing as much sealing as possible around the drive shaft 2 between the first compartment 24 and the second compartment 25.

In the advantageous embodiment shown in FIGS. 3 and 4, the common one-piece casing 5, 18 is connected to the first end of the pump stator 1 via a bearing support 26 having a first bearing 15 for guiding the drive shaft 2. The first bearing 15 is placed as close as possible to the motor unit 200 in order to reduce the cantilevered-out length of the drive shaft 2.

In FIG. 3, there can also be seen the suction inlet 27 and the delivery outlet 28 of the vacuum pump 100.

The motor casing 5 also has a duct 29 for conveying cooling fluid.

Figure 1:
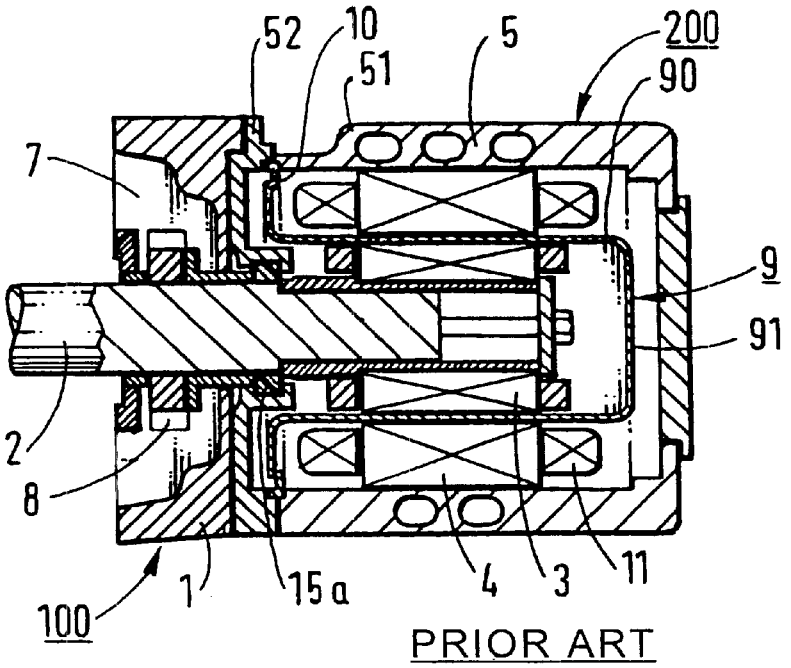
FIG. 1 is a longitudinal section view of a motor unit of the prior art.

The structure of the invention serves simultaneously to provide a better cooling of the portion of the pump stator 1 close to the motor unit 200 because of the continuous metal structure formed by the common one-piece casing 5, 18 which is distinct from the leakproof resin which is confined inside said common one-piece casing 5, 18. Also, shortening the cantilevered-out length of the drive shaft 2 serves to avoid vibration and reduce the noise generated by the vacuum pump unit. It thus becomes possible to avoid resorting to an additional bearing (15*a*, FIG. 1) between the gears 17 and the rotor 3 of the motor. In other words, as shown in FIG. 3, the drive shaft 2 is then cantilevered-out from the first guide bearing 15, i.e. along the segment of drive shaft 2 carrying both the rotor 3 of the motor and the gears 17.

The length of the stator of the motor and the resulting cantilevered-out length can be further reduced for identical motor torque by using a motor 3, 4 having four poles fed at double frequency 2F (in practice 200 Hz, for example), instead of using a two-pole motor fed at single frequency F (in practice 100 Hz, for example). Because there is no leakproof jacket in the airgap, it is possible to use a four-pole motor powered at double frequency 2F without creating exaggerated losses in efficiency. That is not possible with prior art structures using a leakproof jacket since operating at double frequency 2F gives rise to losses of efficiency that are excessive.

The present invention is not limited to the embodiments explicitly described, and it includes the various generalizations and variants that are within the competence of the person skilled in the art.

What is claimed is:

1. A dual-rotor vacuum pump unit comprising a pump stator with at least one axial internal cavity receiving two parallel pump rotors mounted to rotate on corresponding bearings and coupled together at a first end by a set of gears enclosed in a gear casing containing oil, the first end of one of the pump rotors being extended axially by a drive shaft engaged in the rotor of a motor unit for driving the vacuum pump, the motor unit having a stator coil and being enclosed in a motor casing extending the gear casing, wherein:

the motor casing and the gear casing form a common one-piece casing connected to the first end of the pump stator of the vacuum pump;

inside the common one-piece casing, the stator coil of the motor unit is embedded in a leakproof resin providing sealing that prevents oil and gas escaping to the outside.

2. A pump unit according to claim 1, wherein the common one-piece casing includes an intermediate wall between a first compartment containing the motor and a second compartment containing the set of gears, and including a passage for the drive shaft with a dynamic seal to provide sealing around the drive shaft between the first compartment and the second compartment.

3. A pump unit according to claim 1, wherein the common one-piece casing has an axial end opening closed in leakproof manner by a closure hatch.

4. A pump unit according to claim 1, wherein the common one-piece casing is connected to the first end of the pump stator via a bearing support having a first bearing for guiding the drive shaft and placed as close as possible to the motor unit.

5. A pump unit according to claim 4, wherein the drive shaft is cantilevered-out from the first guide bearing.

6. A pump unit according to claim 1, wherein the motor is a four-pole motor fed at double frequency.

* * * * *